United States Patent [19]

Sälzer

[11] Patent Number: 4,661,805

[45] Date of Patent: Apr. 28, 1987

[54] DEVICE FOR INDICATING THE MOVEMENT AND/OR POSITION OF A SHUTOFF MEANS

[76] Inventor: Heinrich Sälzer, Industriestrasse 4, 3550 Marburg-Wehrda, Fed. Rep. of Germany

[21] Appl. No.: 908,007

[22] Filed: Sep. 15, 1986

Related U.S. Application Data

[63] Continuation of Ser. No. 709,574, Mar. 8, 1985, abandoned.

[30] Foreign Application Priority Data

Mar. 16, 1984 [DE] Fed. Rep. of Germany ..... 3409649

[51] Int. Cl.[4] ..... G08B 13/08

[52] U.S. Cl. ..... 340/545; 340/547

[58] Field of Search ..... 340/545, 547

[56] References Cited

U.S. PATENT DOCUMENTS

| | | | |
|---|---|---|---|
| 3,771,153 | 11/1973 | Byrne | 340/547 |
| 3,828,340 | 8/1974 | Bauer, Jr. et al. | 340/547 |
| 4,074,246 | 2/1978 | Conklin et al. | 340/545 |
| 4,170,005 | 10/1979 | Duke | 340/547 |
| 4,379,289 | 4/1983 | Peck | 340/600 |
| 4,583,082 | 4/1986 | Naylor | 340/545 |

*Primary Examiner*—Glen R. Swann, III

*Attorney, Agent, or Firm*—Arthur B. Colvin

[57] ABSTRACT

A tamper resistant device is disclosed for dependably indicating when a door or other shut off means has reached a closed position. The device includes a series of transmitting and receiving elements brought into juxtaposition during or at the final closing movements of the door. The device may include read out means responsive to the sequence of activation of the receiving elements and/or the identity of the receiving elements activated.

4 Claims, 2 Drawing Figures

Fig. 1
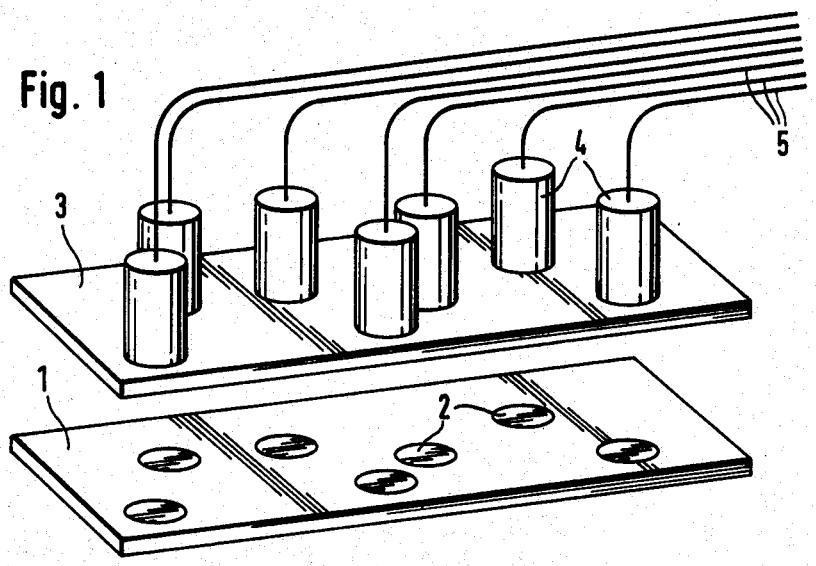
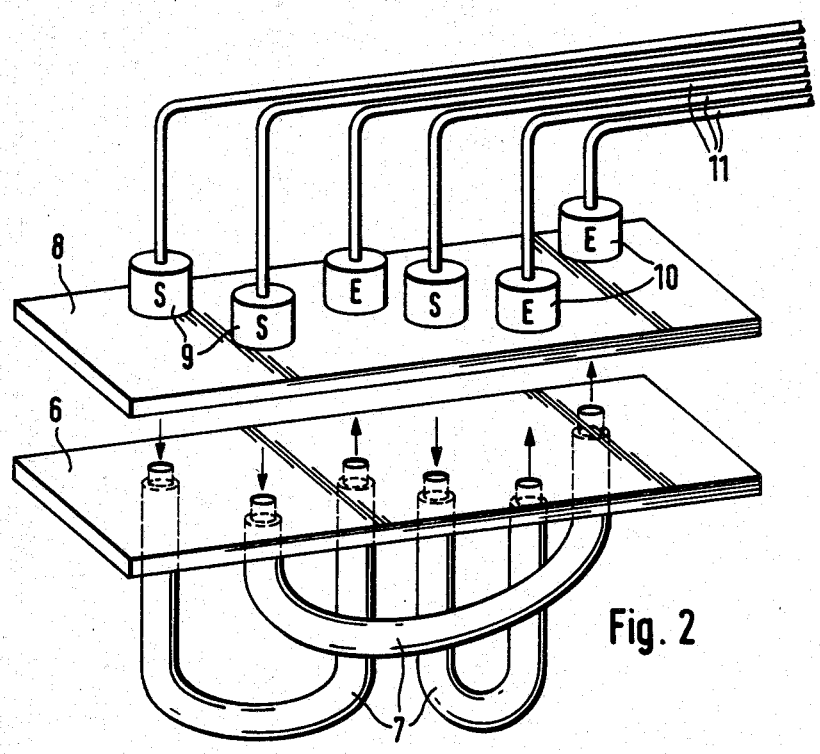
Fig. 2

DEVICE FOR INDICATING THE MOVEMENT AND/OR POSITION OF A SHUTOFF MEANS

CROSS REFERENCE TO A RELATED APPLICATION

This application is a continuation of my abandoned application Ser. No. 709,574 filed Mar. 8, 1985.

BACKGROUND OF THE INVENTION

This invention relates to a tamper resistant device for indicating the movement and/or position of a closure means with respect to a frame surrounding the closure means to dependably indicate that the means is in the shut position.

Devices of this kind are generally known in a variety of designs and serve the purpose, for example, of centrally monitoring the particular positions of several successive doors forming a sluice gate system. This is to make sure that several doors are not unlatched simultaneously to provide access to an area to be secured and to guard against the possibility that despite proper actuation of the locking means a door remains in an open position.

For central monitoring of such sluice gate systems one possibility is to use video monitoring equipment. Apart from the fact that these equipments are relatively expensive, the cameras cannot be protected against unauthorized intervention. Also, the image reproduction equipments (viewers) overtax the monitoring personnel, especially if a large number of them must be watched simultaneously.

The attempt has also been made before to monitor the positions of doors of such sluice gate systems with magnetic contacts disposed on the door frames. By an iron plate correspondingly disposed on the door panel, the magnetic contacts can be activated, and thereby the closed position of the door panel can be signaled. However, with the aid of such an iron plate or of an object similar to it with comparable ferromagnetic properties this monitoring system is especially easy to outwit and a closed position of the door panel can be simulated without the actual open position of the door panel being perceivable in a central monitoring station.

Lastly a sufficiently reliable indication of the position of doors is not assured either with the aid of so-called rotary position indicators mounted on the door hinge plate, as they, too, cannot be sufficiently secured against tampering.

SUMMARY OF THE INVENTION

It is the object of the invention to provide a tamper resistant device for indicating the sliding or rotary movement and/or position of a closure means at or to the closed position. Like known devices of this kind, the device is accessible to unauthorized intervention. However, the device of the present invention indicates every manipulation and thereupon blocks an unlatching of the closure means.

According to the invention there is provided a plurality of signal transmitters and signal receivers on the door and frame, the elements being positioned to come into coincidence in a certain sequence during the pivoting movement of the closure means. This arrangement makes it possible to display the proper movement sequence in a central monitoring station and to record the attainment of the closed position as prerequisite for the unlatching process of a following closure means which forms for example a sluice gate system with the preceding one. Since from the plurality of the signal transmitters and signal receivers only a certain number, not recognizable by unauthorized persons, have been selected for the signal transmission, and since the selected number causes the signal transmission in a sequence also not recognizable by unauthorized persons, it is not possible by a manipulation to simulate a position of the closure means which does not correspond to the actual position. Apart from that, every signal transmission not coded leads to a display identifying it as unauthorized tampering in the central monitoring station, so that appropriate measures can be taken.

According to a variant of the invention, the signal transmitters and receivers consist of activatable magnets which are arranged at different distances from the axis of rotation of a door panel or window casement and/or on different rays extending through the axis of rotations of the door panel or window casement, or they consist of light emitters or infrared emitters energized through glass fiber cables.

By the novel arrangement of the signal transmitters and receivers at different distances from the axis of rotation and/or on different rays which extend through the axis of rotation of the panel, there results in every position of the panel a certain contact situation which changes as a function of the pivoting movement of the panel in a precisely given sequence. Manipulation of the magnetic contacts, acting for example as signal transmitters and receivers, is indeed possible, but is detectable immediately. If infrared emitters are used as signal transmitters, it is assured moreover that it is impossible for unauthorized persons to determine the sequence—barely perceivable anyway—of the signal transmission, whereas visible light rays could indeed give information about a certain sequence, which, however, it is practically impossible to reproduce to simulate a movement or position of the shutoff means.

Preferably the signal transmitters and receivers are arranged in the upper and/or lower end face of the door panel or window casement, and the signal receivers and transmitters in the leg of the door panel or window casement lying opposite these end faces, and they form a structural unit in each instance.

This design makes it possible in an especially simple manner to retrofit for example doors of sluice gate systems with the device according to the invention.

To be able to monitor a number of shutoff means with a single control system or checking equipment, a variant of the invention provides that the signal transmitters and receivers of different shutoff means form interruptable connections to a master control, read out or checking system.

With commercial computers it is possible to establish and display the proper signal sequences of a large number of shutoff means on the basis of appropriate programming and to control the necessary latching and unlatching processes.

BRIEF DESCRIPTION OF THE DRAWINGS

In the drawing, two embodiments of a means for signal transmission in a closure means according to the invention are illustrated.

FIG. 1 shows a diagrammatic representation of a device equipped with magnetic contact and magnetic plates;

FIG. 2 shows a diagrammatic representation of a similar device equipped with infrared transmitting and receiving diodes and glass fiber cables.

DESCRIPTION OF THE PREFERRED EMBODIMENTS

The device according to FIG. 1 consists of a plate type structural unit 1, in which seven magnets 2 are embedded in a certain arrangement. The structural unit 1 in turn is embedded for example in the upper end face of a door panel not shown.

In the closed position of the door panel, the structural unit 1 is opposite a plate type structural unit 3, embedded for example in a door frame also not shown, which is equipped with seven magnetic contacts 4 whose arrangement matches the arrangement of the magnets 2 of structural unit 1. Lines 5 leading to a checking or read out equipment (not shown) are connected at the magnetic contacts 4.

Only in the closed position of the door panel does the magnetic plate 2 lying opposite a magnetic contact 4 hold the respective magnetic contact 4 closed. But since some magnets 2 can be replaced by plates which do not activate the respective magnetic contacts 4, the checking equipment indicates a closed position of the door panel only when certain selected magnetic contacts 4 are closed while other magnetic contacts 4 are open. The attempt to outwit the device by contact closure of all magnetic contacts or of a group other then the selected group provided will therefore be indicated by the checking equipment.

The device according to FIG. 2 again consists of a plate type structural unit 6, through which loops of three glass fiber cables 7 are passed in a certain arrangement. The structural unit 6 is again embedded for example in the upper end face of a door panel not shown.

In the closed position of the door panel, the structural unit 6 is opposite a plate type structural unit 8, embedded for example in a door frame also not shown, which is equipped with three infrared emitting diodes 9 and three infrared receiving diodes 10, whose arrangement is selected so that at one end a loop of glass fiber cable 7 is opposite an infrared emitting diode 9 and at the other end an infrared receiving diode 10. The infrared emitting and receiving diodes 9 and 10, respectively, are connected via lines 11 with a checking equipment not shown.

Only in the closed position or approaching closed position of the door panel, the infrared rays emanating from certain emitting diodes 9 are propagated via the respective loops of the glass fiber cables 7 to the receiving diodes 10, so that a closed position of the door panel cannot be simulated even when only certain diodes are made use of to indicate the position of the door panel. In this manner and through the use of false triggering receiving elements, it is possible to assure that a door or like closure means has in fact been shifted to the shut position and to immediately expose attempts to tamper.

As will be apparent from the above disclosure numerous variations in details of construction are possible without departing from the spirit of the invention which is thus to be broadly construed within the scope of the appended claims.

Having thus described the invention and illustrated its use, what is claimed as new and is desired to be secured by Letters Patent in the United States is:

1. A tamper proof device for indicating the movement and position of a closure member relative to a frame member adapted to surround said closure member in the shut position of said closure member comprising a plurality of signal transmitters on one said member, a plurality of signal receivers on the other said member, at least a plurality of said transmitters and receivers being in registry in said shut position, said transmitters being positioned relative to said receivers such that certain said receivers are activated by certain said transmitters in a predetermined sequence responsive to movement of said closure member to and from said shut position and readout means operatively connected to said receivers, said readout means being responsive to the sequence in which signals from said transmitters are impressed on said receivers.

2. Apparatus in accordance with claim 1 wherein at least certain of said receivers are out of registry with certain of said transmitters in the shut position of said closure member, and said readout means is responsive to signals generated in said certain ones of said receivers.

3. Apparatus in accordance with claim 1 wherein said transmitters and said receivers comprise respectively magnets and magnetically responsive means.

4. Apparatus in accordance with claim 1 wherein said transmitters comprise radiation emitters and said receivers comprise radiation sensors.

* * * * *